United States Patent [19]

Bell

[11] 4,432,460

[45] Feb. 21, 1984

[54] DEVICE FOR THE RECEPTION OF LEAF-SHAPED BODIES ESPECIALLY OF SHEETS OF PAPER

[76] Inventor: Barbara E. Bell, Achalmstr. 4, D-7447 Aichtal, Fed. Rep. of Germany

[21] Appl. No.: 209,737

[22] Filed: Nov. 24, 1980

[30] Foreign Application Priority Data

Nov. 24, 1979 [DE] Fed. Rep. of Germany ..... 2947397

[51] Int. Cl.[3] ..... A47F 5/08

[52] U.S. Cl. ..... 211/50; 211/55; 211/88

[58] Field of Search ..... 211/40, 41, 50, 55, 211/87, 88; 40/2 R, 19.5

[56] References Cited

U.S. PATENT DOCUMENTS

| | | | |
|---|---|---|---|
| 491,649 | 2/1893 | Hofmann | 211/50 X |
| 1,284,783 | 11/1918 | Ryan | 211/50 |
| 1,525,318 | 2/1925 | Payzant | 211/50 X |
| 2,105,594 | 1/1938 | Henrich | 211/50 |
| 3,165,318 | 1/1965 | Lissandrello | 211/50 X |

*Primary Examiner*—Ramon S. Britts
*Assistant Examiner*—Robert W. Gibson, Jr.
*Attorney, Agent, or Firm*—Roylance, Abrams, Berdo & Farley

[57] ABSTRACT

A display board for receiving and holding cards or sheets of paper or the like so that information thereon is visible includes a rectangular front wall which is transparent, a rectangular back wall which is opaque and spacing strips between the walls. The spacing strips maintain the walls in spaced relationship and define a plurality of rectangular compartments between the walls. The back wall has slots located at the top of each compartment for insertion and removal of cards. The spacing strips and slots are shaped so that the cards can be removed, but can not be inadvertently spilled.

8 Claims, 4 Drawing Figures

DEVICE FOR THE RECEPTION OF LEAF-SHAPED BODIES ESPECIALLY OF SHEETS OF PAPER

The invention relates to a device for receiving leaf-like articles such as sheets or pieces of paper or the like and for holding such articles so that inscriptions thereon can be seen.

The present invention provides a protected accommodation for the leaf-shaped bodies held in the device, so that the sheets are not simply or easily removable from this device. This objective is achieved by providing a device having two generally parallel, spaced apart walls, separating strips extending between and separating the walls and dividing the volume between the walls into a plurality of compartments, one of the walls being transparent in at least the regions of the compartments, the other wall having a plurality of inserting slits located so that one slit is associated with each compartment and so that leaf like articles can be selectively inserted into and removed from the compartments through the slits.

In the compartments defined by the walls of the device and divided by separating strips, leaf-shaped bodies may be accommodated in a protected manner. Each leaf-shaped body may be inserted into the compartment provided for its reception only by way of the inserting slit and then may also be removed from it only by way of such inserting slit. Therefore, each body is covered up by the device nearly to its entire extent.

The device is especially suitable for use as an indicator board, an inspection panel etc. It may be disposed between other board-shaped bodies such as, for example, records inserted in envelopes. The sheetlike bodies may then contain data concerning the records on at least one side of the device.

The insertion and withdrawal of sheet-shaped bodies from the device is facilitated by locating a separating strip with a beveled surface adjacent a slit forming an inclined plane on the strip and extending out to the outer limit of the slit so that the slit is enlarged toward the outside. These features permit easy insertion and withdrawal of the bodies without increasing the amount of exposure of the bodies or of the compartment.

Each slit can be provided with a semicircular, enlarged recess at one side. The recess is of a size to receive a thumb making it easier to grasp one of the leaf-shaped bodies.

By providing openings only in one of the walls and leaving the other wall continuously closed, the structure is arranged such that the compartments of the device or the leaf-shaped bodies in these compartments are accessible only from one side.

Simple production of the device is made possible by providing the wall having the slits with the separating strips formed thereon and, additionally, with a peripheral strip protruding further than the separating strips to define a space to receive the other wall which, as previously mentioned, is flat and transparent. This simplifies production because only one of the walls is provided with projections for the separating and peripheral strips and the other wall is made completely flat.

The planar walls can be formed so that their major surfaces are rectangular and one side of the major surface of the larger wall is substantially equal to the diameter of a long-playing record. The other side can be longer to make part of the information visible. This results in an arrangement which is particularly advantageous whenever it is disposed between perpendicularly set-up records.

A brief, summary indication of the type of music, language etc., on the records can be provided in an end compartment having an access opening at one side formed by a recess or gap in the peripheral strip. Information can be described in more detail and stored in the other compartments of the device.

Additional advantages result from the remaining description and drawings which disclose a device in the form of a recording or inspection panel for the reception of sheets of paper bearing information as an embodiment of the invention. Referring to the drawings which form a part of this disclosure:

Figure 1:
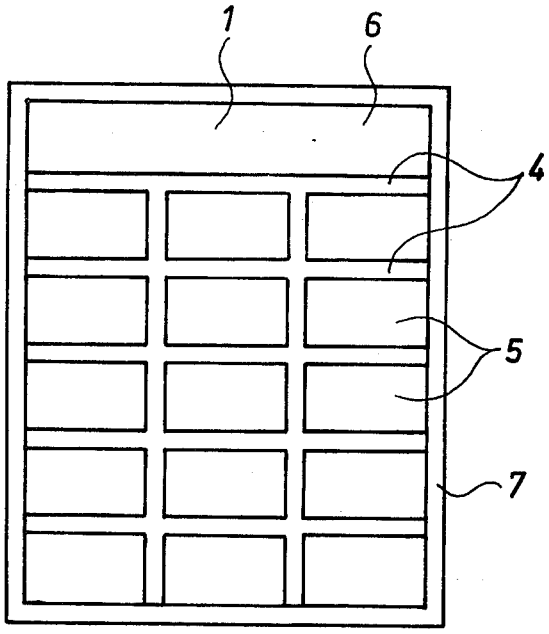
FIG. 1 is a front elevation of a device in accordance with the invention.

The recording board shown in the drawing has a front wall 1 and a rear wall 2. The front wall 1 is formed as a flat, thin plate of a transparent material, for example, polymethacrylic ester (polymethylmethacrylate), which is commercially available under the name of Plexiglas.

Figure 3:
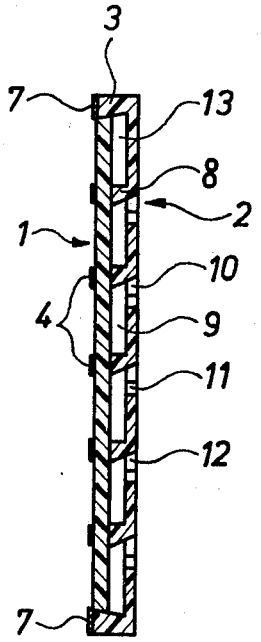
FIG. 3 is a vertical sectional view along line III—III in FIG. 2.

The rear wall is formed of non-transparent plastic, for example, polypropylene, polyvinylchloride etc. The rear wall has a peripheral strip 3, into which the front wall 1 is inserted flush, and by which the front wall 1 is attached to the rear wall 2. An adhesive may be used for fastening the two walls. Alternatively, as shown in FIG. 3, peripheral strip 3 can be formed in a wedge shape in cross section with the narrower portion of the wedge adjacent rear wall 2 so that the inner surface of the peripheral strip 3 forms as acute angle with the rear wall. The peripheral edge of the front wall 1 is formed as a sloping surface to mate with the inside of the peripheral strip 3, to achieve a positive locking connection between the two walls 1 and 2.

The double walled device in the form of an announcement or recording panel, shown in the drawing, is preferably formed so that its major surface is rectangular with the shorter side corresponding to the diameter of a long playing record. In the square portion of the device corresponding to and determined by the diameter of the long-playing record, are fields 5 of equal size which are defined and separated by strips 4 disposed on the front side of the forward wall 1 in perpendicular relationship. A narrow field 6 extends across the entire width of the device, is narrower than the remaining fields 5, occupies the part of the longer side of the rectangle and is located in the drawing above the fields 5. Other dimensional relationships can be selected.

The front of the device is encompassed at its edge by a peripheral strip 7 attached essentially in front of the peripheral strip 3. Strip 7 covers up a part of the front wall 1. Strips 4 cover up separating strips 8 on the rear wall 2, projecting on the same side as the peripheral strip 3. Strips 8 are disposed in the same manner as the strips 4 and extend up to the adjacent side of the front wall 1. A hollow compartment 9, defined by the two walls 1 and 2, corresponds to each of the fields 5. The compartments 9 are separated from each other by separating strips 8.

Figure 2:
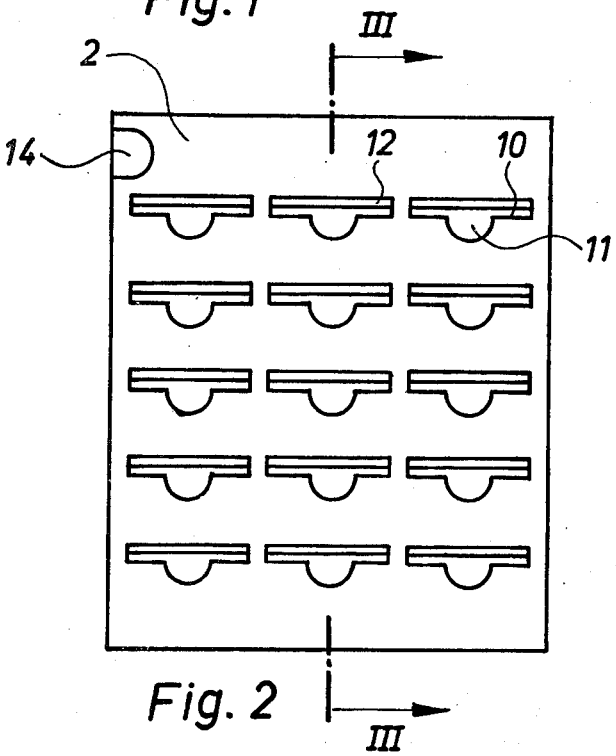
FIG. 2 is a rear elevation of the device of FIG. 1.
Figure 4:
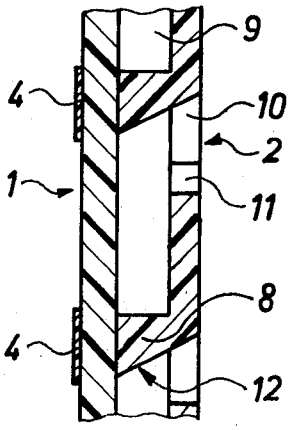
FIG. 4 is an enlarged partial side elevation of a portion of the structure as shown in FIG. 3.

Each of the compartments is accessible through an inserting slit 10 extending across its upper edge, as viewed in the drawing, and essentially over its greatest length. Each slit, at its lower side, shown in FIG. 2, has a semicircular enlargement or recess 11 at least as large as the width of a thumb. The separating strip 8, in the area of the inserting slit 10, has an oblique surface 12 which causes the size of the inserting slit 10 to increase toward the outside. The inserting slit 10 is made such that a sheet of paper or the like, dimensioned to fit in the compartment 9 and carrying some information on its side facing the transparent front wall 1, may be inserted into the inserting slit 10, but does not drop out of it, in the event that the device is turned upside down. The sheet of paper may be taken out only with some difficulty through the inserting slit 10, in order that it may not be spilled out inadvertently.

A compartment 13 extends behind the field 6, which compartment is accessible from the side of the device. At the side of the device, a semicircular, laterally opening recess 14 is provided in the rear wall 2 into which a thumb can be inserted to remove a sheet of paper, etc., located in the compartment 13. This sheet of paper may have data concerning the type of music, language etc., recorded on the records, and summarizing information carried in greater detail on other sheets of paper accommodated in the compartments 9 and visible through the fields 5 on the front of the device. The size of each field 5, for example, is selected so that a section from a catalogue describing a long playing record in more detail, which catalogue has a number of sections of equal size and describing other records in more detail, becomes visible right through field 5.

The sheets of paper insertable into the device and visible through the fields 5, may also have different information. For example, the device may be hung on the wall of a building so that it can be used to receive and display notices. In order to prevent the notices from being taken out, the device can be suspended in such a way that the device may only be removed from the wall of the building with a key.

The thickness of the device made up of the two walls 1 and 2 may be, for example, 5mm. As shown, for example, 15 fields 5 and one field 6 may be provided on the front wall 1. Some other division and/or number of the fields 5, 6 is also possible.

While a certain advantageous embodiment has been chosen to illustrate the invention, it will be understood by those skilled in the art that various changes and modifications can be made therein without departing from the scope of the invention as defined in the appended claims.

We claim:

1. An apparatus for receiving and holding flat bodies such as cards or sheets for display thereof, the apparatus comprising the combination of first and second generally planar, plate-like wall members;

a plurality of separating strips extending longitudinally and transversely between said wall members for maintaining said wall members in substantially parallel, spaced relationship and for dividing the volume between said wall members into a plurality of compartments;

said first wall member being transparent at least in the regions of said compartments, and means defining a plurality of slots through said second wall member, each of said slots opening into one of said compartments adjacent a separating strip defining a top side of the compartment when the apparatus is in a normal, upright position, said slots being formed such that bodies placed in said compartments tend to remain therein when said apparatus is inverted.

2. An apparatus according to claim 1 wherein the surface of each separating strip adjacent a slot is beveled to form an inclined plane enlarging the width of the slot toward the outer surface of said second wall member.

3. An apparatus according to either of claims 10 or 11 wherein said means defining said slots includes means defining an arcuate recess extending outwardly from a side of each slot, said arcuate recess having a width sufficient to admit a thumb.

4. An apparatus according to claim 3 wherein said separating strips are fixedly attached to said second wall.

5. An apparatus according to claim 4 wherein said second wall further includes a peripheral wall encompassing said separating strips and the compartments, said peripheral wall protruding beyond said separating strips and defining a space to receive said first wall.

6. An apparatus according to claim 1 wherein said first and second walls are rectangular with the shorter side of at least one of said walls being substantially equal to the diameter of a long playing record.

7. An apparatus according tp claim 5 and further including means defining an end compartment extending across a short side thereof, and means defining an opening in said peripheral wall to permit access to said end compartment.

8. An apparatus according to claim 5 and further including a plurality of cover strips attached to the exposed major surface of said first wall and overlying said separating strips and said peripheral wall.

* * * * *